US012698950B2

(12) United States Patent
Seigler

(10) Patent No.: US 12,698,950 B2
(45) Date of Patent: Aug. 4, 2026

(54) LASER CARTRIDGE FOR DRYFIRE TRAINING

(71) Applicant: Sarah R. Seigler, Kamiah, ID (US)

(72) Inventor: Stanley H. Seigler, Kamiah, ID (US)

( * ) Notice: Subject to any disclaimer, the term of this patent is extended or adjusted under 35 U.S.C. 154(b) by 701 days.

(21) Appl. No.: 18/081,882

(22) Filed: Dec. 15, 2022

(65) Prior Publication Data

US 2023/0194209 A1 Jun. 22, 2023

Related U.S. Application Data

(60) Provisional application No. 63/291,300, filed on Dec. 17, 2021.

(51) Int. Cl.
*F41G 3/26* (2006.01)

(52) U.S. Cl.
CPC ..... *F41G 3/2655* (2013.01)

(58) Field of Classification Search
CPC ..... F41G 3/2655
See application file for complete search history.

(56) References Cited

U.S. PATENT DOCUMENTS 4,830,617 A * 5/1989 Hancox ..... F41A 33/02 434/21
5,004,423 A * 4/1991 Bertrams ..... F41A 33/02 434/22
5,787,631 A 8/1998 Kendall
6,322,365 B1 * 11/2001 Shechter ..... F41J 5/02 434/21
8,734,156 B2 5/2014 Uhr
9,182,189 B2 11/2015 Seigler
9,303,941 B2 4/2016 Foege
9,746,271 B2 8/2017 Hughes
11,313,638 B2 4/2022 Dottle
11,460,271 B2 10/2022 Seigler
11,585,636 B2 * 2/2023 Oliver ..... G09B 9/003
2002/0057719 A1 * 5/2002 Shechter ..... F41A 33/02 372/16
2003/0091960 A1 * 5/2003 Rosa ..... F41J 7/04 434/21
2011/0207088 A1 * 8/2011 Uhr ..... F41A 35/00 434/21
2023/0106290 A1 * 4/2023 Uhr ..... F41A 35/00 434/21

* cited by examiner

*Primary Examiner* — Robert P Bullington
(74) *Attorney, Agent, or Firm* — Randall Danskin P.S.

(57) ABSTRACT

This is a cartridge shaped laser dry fire training device that can be inserted into the chamber of a firearm and used for demonstrating where the simulated shots strike during each trigger press of a dry fire practice session when coupled with the DryFireMag training device as disclosed in U.S. Pat. No. 9,182,189 B2. The laser dry fire training device preferably is composed of a red diode laser, a set of batteries, and electronic PC board, a lens to allow the infrared light emitted by the diode mounted on a specially designed dry fire training magazine to excite the electronics of the electronic PC board, and two threaded cylinders to house said components.

18 Claims, 4 Drawing Sheets

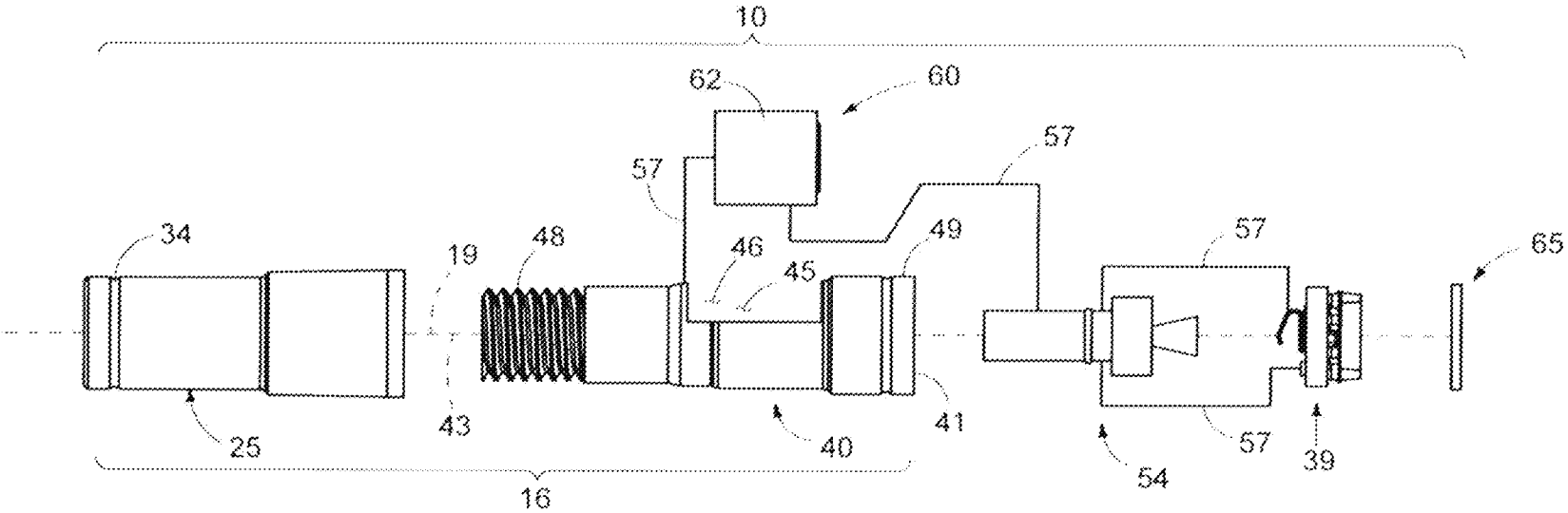
FIG. 2
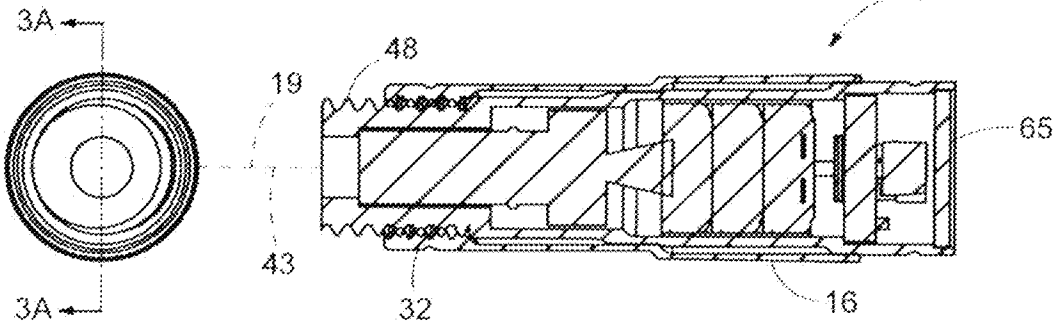
FIG. 3A
FIG. 3

LASER CARTRIDGE FOR DRYFIRE TRAINING

RELATED APPLICATIONS

This US Non-Provisional Patent Application claims priority to earlier filed U.S. Provisional Patent Application Ser. No. 63/291,300 filed on 17 Dec. 2021 and titled Laser Cartridge for Dryfire Training. The inventorship of earlier filed U.S. Provisional Patent Application Ser. No. 63/291,300 filed on 17 Dec. 2021, and the present US Non-Provisional Patent Application, is the same.

The entire contents of earlier filed U.S. Provisional Patent Application Ser. No. 63/291,300 filed on 17 Dec. 2021 is fully and completely incorporated herein, by this reference.

Pursuant to USPTO rules, this claim of priority to earlier filed U.S. Provisional Patent Application Ser. No. 63/291,300 filed on 17 Dec. 2021, is also included in the Application Data Sheet (ADS) filed contemporaneously herewith.

TECHNICAL FIELD

The present invention relates to firearms and more particularly to training devices for firearms, and even more particularly to an electronically powered and light actuated laser cartridge for use in dryfire training with a firearm.

There are multiple types of laser cartridges for use with firearms and for use in training with firearms. All known laser cartridges aid the shooter in determining where the simulated shots hit, Some laser cartridges are in a continuous "on" status and stay "on" continuously during the dry fire practice session. Other laser cartridges are activated by a vibration caused by release, and stopping, of a firing pin, by audible sound, and still others are actuated when struck/physically impacted by the firearm's firing pin.

BACKGROUND OF THE INVENTION

Live fire (using live ammunition) is essential to practice drawing and firing a weapon and historically has been the primary method of training with firearms. The practice process builds muscle memory, and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

More recently, experts have recognized that dry fire practice (practicing without live ammunition) is an essential addition for live fire practice to be successful and effective. Dry firing is another process of building muscle memory whereby a firearm, especially a pistol, is drawn, aimed, and fired without using live ammunition. This enables the practice of firing a weapon to proceed smoothly and accurately without all of the negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in the home. With complete safety, actual shooting scenarios can be practiced in and around the home.

Practicing at the range can also be improved. When live fire is practiced at the range, the novice shooter usually has to spend a significant amount of time and expend a lot of ammunition getting accustomed to the report and recoil of the pistol. Before live practice begins, some dry fire practicing can be done. This gets the shooter accustomed to the trigger feel before having to deal with the recoil and the report of live firing.

One negative factor with most methods of dry firing occurs because when a semi-automatic pistol is live fired, the live firing resets the firing pin and/or trigger and is the firearm ready to be fired again until the magazine is empty. The shooter's hands remain in the firing position, and just the trigger finger and the trigger are employed. With normal dry fire practice, after the first activation of the trigger releasing the firing pin, the shooter must remove a hand from the pistol, and "rack" the slide back in order to reset the firing pin and to return the trigger and firing pin to an unfired position. The pistol is then ready for another activation. This must be done each time a shot is simulated. Doing this teaches improper muscle memory because it is not at all what happens during actual live fire. When people are in real shooting situations, they need to be able to depend on simply acting upon how they have practiced. Anything else could be deadly and some situations have proven catastrophic.

Another negative for standard dry fire practice is wear and tear caused by repeated releasing of a weapon's firing pin without having the cushioning effect of the firing pin striking a round of ammunition.

Some firearm training systems incorporate computer graphics into the training scenario. Other patents address the duplication of a pistol's recoil, laser marking of "shots", projecting images onto a screen, etc.

Further drawbacks of known devices and systems are that such devices/systems are user intensive and/or expensive to purchase, and significantly do not allow a shooter to use a fully functioning pistol that may already be owned. There is also a learning curve and training necessary to use such devices/systems. Only one known dry fire practice device, (U.S. Pat. No. 9,182,189) resolves various of these drawbacks including, but not limited to, resolving the "hands-free" trigger reset problem and the possible firing pin damage problem of normal dry fire practice. Said U.S. Pat. No. 9,182,189 was invented and patented by the inventor herein, Stanley H. Seigler.

U.S. Pat. No. 9,182,189 addressed various drawbacks to known devices and systems, but further developments and improvements were envisioned which enabled the device to interact with electronic training systems through a micro switch and related electronic components so as to facilitate use with devices such as lasers and laser cartridges.

There is a remaining need for a dry fire training device that uses a fully functioning pistol, allows for precise muscle memory training, is simple to operate, prevents the firing pin of the fully functioning pistol from being damaged, provides for safe on-site home training, inserts easily into the magazine well, and has capabilities to interact with electronic training systems. The present laser cartridge improves upon, and is used in conjunction with my existing U.S. Pat. No. 9,182,189 and its continuing improvements.

Laser cartridges provide needed feedback to the shooter so that improvements can be made to help the shooter to become more proficient in training. One continuing drawback encountered with dry fire training is that there has not previously been a successful way to allow the shooter to simulate follow-up shots without removing the sub dominant hand from the pistol and "racking" (or otherwise "re-setting") the firearm's slide to reset the firearm's firing pin and trigger so that a second practice shot can be accomplished.

When the sub dominant hand is used to reset the firing pin, the shooter loses the site picture, and the shooter cannot practice the much-needed double-shot ("double tap") or multiple shot practice.

Additional drawbacks to known laser cartridges which are actuated by sound, or by vibration, or by impact include, but are not limited to, the fact sound frequencies change and/or are muffled by environmental conditions including humidity, elevation and background noise, as well as individual shooter characteristics, such as, but not limited to large vs. small hands, use of gloves, hand position, left hand vs. right hand, accessories attached to the firearm such as, but not limited to, sites, laser sites, silencers, grips, age of the firearm and wear/tear of the firing pin and related components. As a result, and due to these infinitely changing circumstances, the use of sound and/or vibration and/or impact to actuate a laser cartridge has proven difficult, inconsistent, not reliable, and continually in need of changes and adjustments, all of which negatively affect training, which by its very nature must be consistent.

What is needed is a laser cartridge dry fire practice training device that is consistent, safe, can be used in/with the shooter's personal firearm and which overcomes the known various and voluminous drawbacks to known dry fire laser cartridge systems and devices.

The present invention resolves this continuing need by providing a dry fire laser cartridge training device that operates in combination with the dry fire training device of U.S. Pat. No. 9,182,189 B2, and the subsequent improvements thereof, allows the shooter to practice without removing the sub dominant hand from the firearm. The present inventive laser cartridge uses a light signal. No other training device has the capability to react to a light signal emitted by a dry fire training practice device that simulates the release and reset of the firing pin and/or trigger of a firearm during dry fire practice, and which is physically and electronically independent of the firearm's firing pin which need not move during the dry fire practice.

SUMMARY OF THE INVENTION

The invention described accomplishes important aspects of dry fire training: no live ammunition is used providing safety and no on-going expense, convenience of practicing in the home environment where the protective, fully functioning pistol would most likely be used for defensive purposes, no disassembling and reassembling of any of the fully functional pistol's components, the realistic feel of the trigger during the firing process and the trigger reset, precise muscle memory training using only the trigger finger motion, and does not negatively affect the fully functional pistol's firing pin and there is a visual indicator of where the simulated shot would impact/strike if live ammunition were used. This invention also helps a shooter train with his pistol before he has to deal with the recoil and the report of firing live ammunition. This invention is simple to use, provides realistic feel of the trigger operation, produces a sound that simulates the release of the pistol's firing pin, does not require any alterations to the fully functional pistol such as disassembling and reassembling of any parts of the pistol and provides a visual indication of the simulated shot's impact/strike point. There is therefore a need for a dry fire training device that uses a fully functioning pistol, allows for precise muscle memory training, is simple to operate, prevents the firing pin of the fully functioning pistol from being damaged, provides for safe on-site home training, inserts easily into the magazine well, and which actuates a laser cartridge positionally maintained within the firearm's ammunition chamber. This improved device addresses these situations by providing a laser cartridge that is positioned within the firearm's chamber, and a training apparatus within the firearm's magazine compartment, and the two components communicate with one another by means of emitted, and received, Infrared-light which responsively actuates a visible laser beam, that may or may not be pulsed, and the emitted laser beam (pulsed or not) is transmitted along a bore of the firearm and outwardly from the firearm's muzzle so as to be projected upon a precise location where a firearm bullet would strike if real ammunition were being fired. This device functions completely independently of the pistol's firing pin.

A solution to these continuing drawbacks is to provide a training device that is carried within a firearm's ammunition magazine and the training device simulates the sound and sensation of a release of a firearm's firing pin responsive to actuation of the firearm's trigger (a trigger pull), and responsive to the trigger pull actuating the laser cartridge responsive to the simulated firing pin release.

A principal aspect of the present invention is to provide a laser cartridge for dry fire practice for a firearm comprising: a two-piece rigid housing; and electronic laser source; a multi-battery power supply; a battery protective sheath; an O-ring; and electronic PC board; and a lens.

A further aspect of the present invention is a laser cartridge wherein said rigid housing, approximately the same size and shape as an ammunition cartridge, is made of two hollow cylinders, one with inner threads on the other with outer threads so that the two cylinders can be screwed together.

A further aspect of the present invention is a laser cartridge wherein said rigid housing is made so that it can in case an electronic laser source.

A further aspect of the present invention is a laser cartridge wherein said rigid housing is made so that it can in case the multi-battery power supply for said laser cartridge and the battery power supplies protective sheath.

A further aspect of the present invention is a laser cartridge wherein said rigid housing is made so that it can in case the lens.

A further aspect of the present invention is a laser cartridge wherein said rigid housing is made with an exterior circumference groove so that it can provide a location for the O-ring to be retained, said O-ring providing contact with a firearms barrels chamber for secure location of the laser cartridge.

A further aspect of the present invention is a laser cartridge wherein said electronic laser source is a diode laser with the electronic circuitry to produce a laser pulse. A further aspect of the present invention is a laser cartridge wherein the multi-battery power supply is comprised of batteries physically connected to the electronic laser source and the electronic PC board.

An even still further aspect of the present invention is a laser cartridge wherein said lens allows a light signal to interact with the electronic PC board and then activate the electronic laser source, said light signal which is emitted from a diode of a dry fire training magazine U.S. Pat. No. 9,182,189 B2 and subsequent improvements.

BRIEF DESCRIPTIONS OF THE DRAWINGS

FIG. 2 is an exploded, orthographic side view of the laser cartridge of the present invention.

FIG. 3 is a sectional view of a practice ammunition magazine having a micro-switch and a light source for emitting light that is received by the PC board of the present invention.

DETAILED DESCRIPTION OF THE PREFERRED EMBODIMENTS

Figure 1:
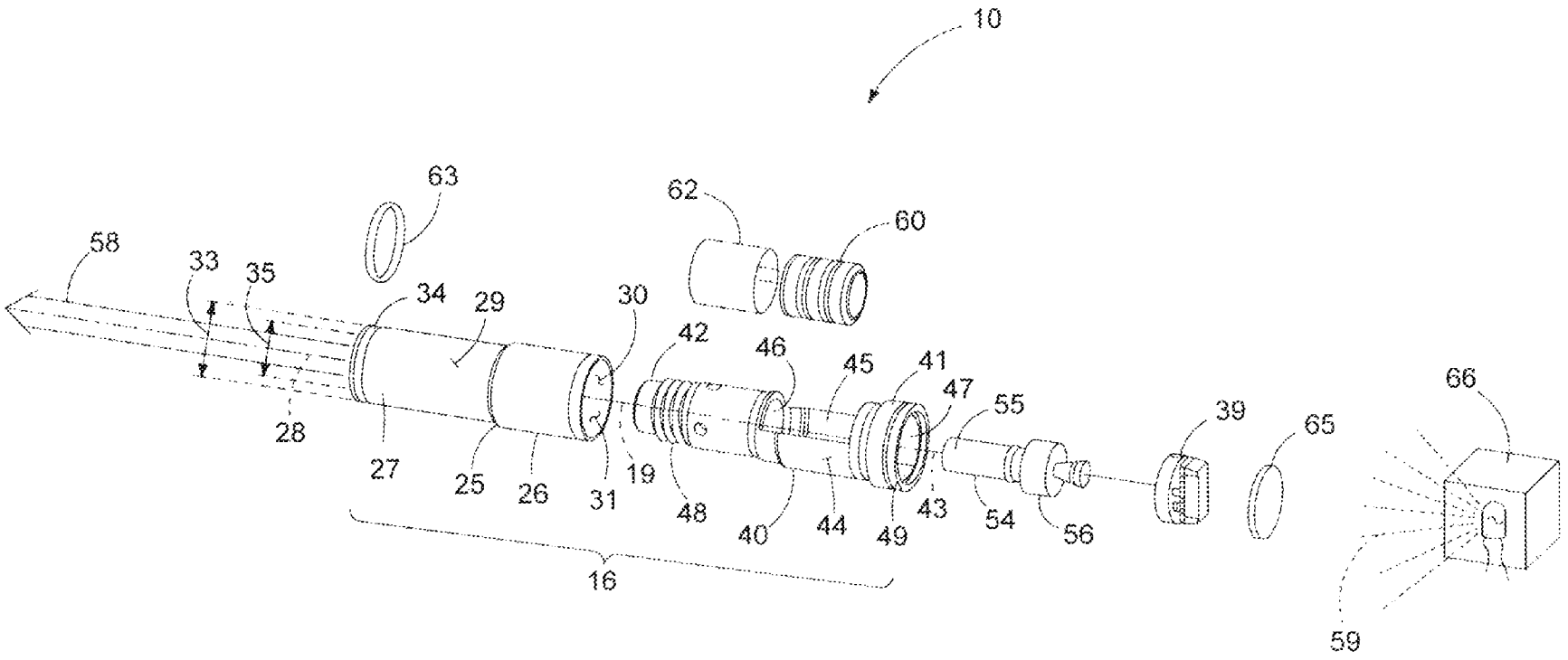
FIG. 1 is an exploded perspective view of the laser cartridge of the present invention showing the various components.
Figure 4:
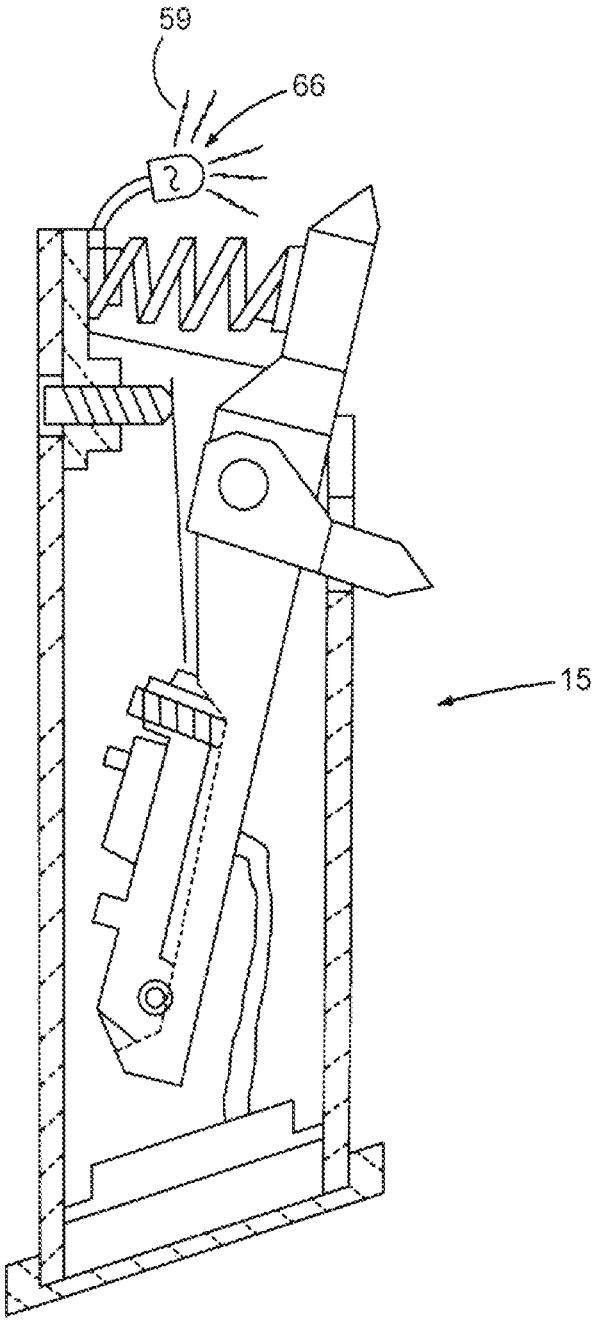
FIG. 4 is a perspective exploded view of a representative firearm (a semi-automatic pistol) that would be used with the present invention showing the dryfiremag having the light emitting light source.
Figure 5:
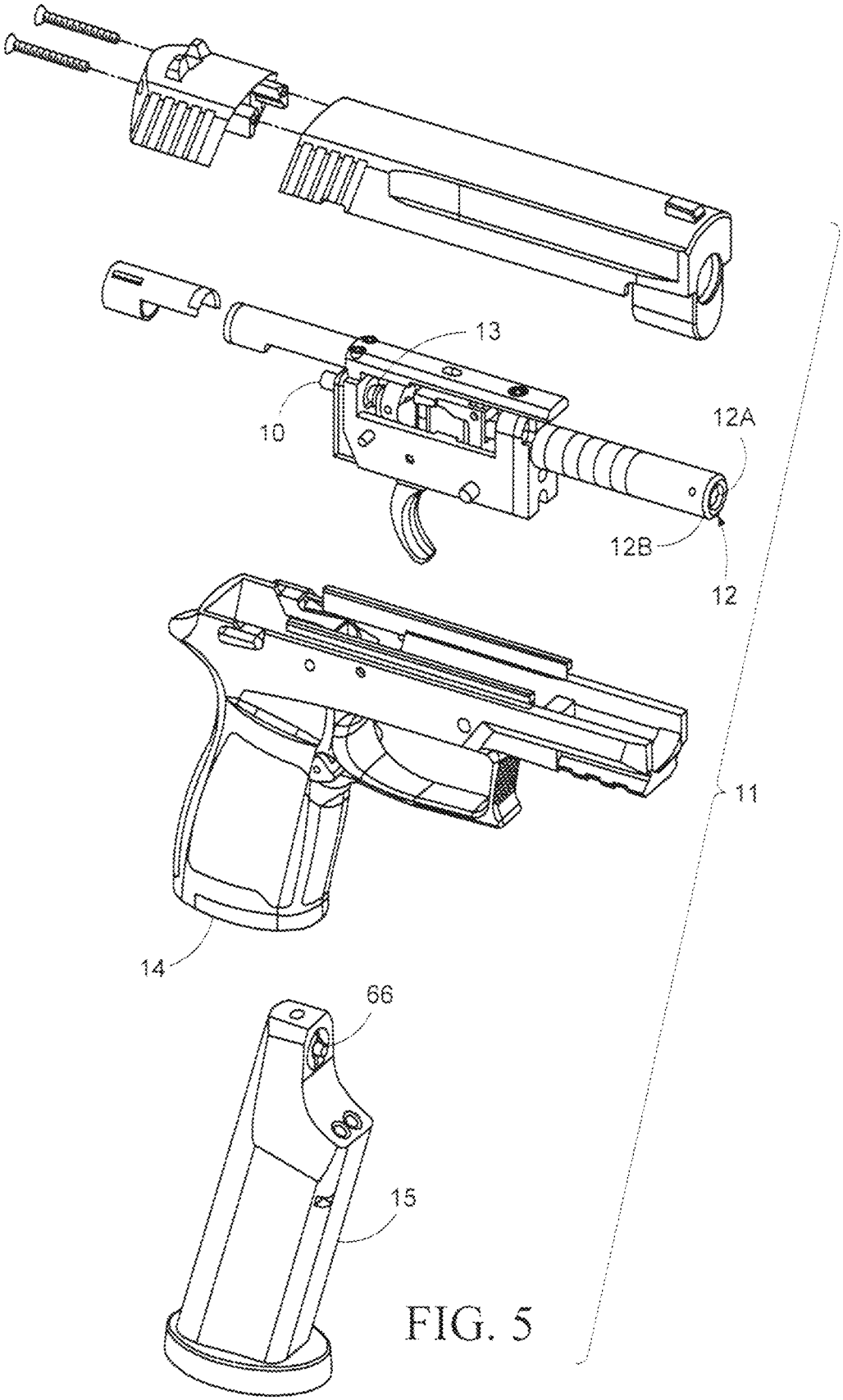
FIG. 5 is an exploded perspective view of a representative firearm (a semi-automatic pistol) showing the various components separated from one another and generally vertically aligned with one another to show how the various components interfit.

This disclosure of the invention is submitted in furtherance of the constitutional purposes of the U.S. Patent Laws "to promote the progress of science and useful arts" (Article 1, Section 8).

My laser cartridge 10 for dry fire training generally provides a rigid housing 16 that is comprised of a generally cylindrical and tubular first member 25 and a generally cylindrical second member 40 that is removably carried within an axial medial channel defined by the first member; a power supply 60; a protective sheath 62; a laser 54; a PC board 64; and an optical lens 65.

The laser cartridge 10 is for dry fire training with a firearm 11, the firearm 11 using a dryfiremag training magazine 15 that has a trigger actuated light source 66. The light source 66 emits electromagnetic waves in a predetermined wavelength, such as, but not limited to human visible light, human invisible light, ultraviolet light, infrared light. When actuated by the firearm trigger, the light source 66 emits and passes light (electromagnetic waves) into the firearm's chamber 13 where the emitted and passed light is received by the optical lens 65. There is no physical and/or electronic and/or mechanical interconnection between the firing pin of the firearm 11 and the laser cartridge 10. Movement of the firearm's 11 firing pin is not required nor needed to actuate the laser cartridge 10.

The laser cartridge 10 which is formed of the generally cylindrical rigid housing 16 is configured (generally) in the shape of an ammunition cartridge that has dimensions (length and diameter) to generally replicate an ammunition cartridge of the size/caliber of the firearm 11 being used. It is contemplated that diameter adapters. (Not Shown) such as, but not limited to, partial or complete sleeves, rings, O-rings, and spacers may be used to effectively alter the length and diameter dimensions of the rigid housing 16 so as to make the rigid housing 16 releasably "fit" within the chamber 13 of multiple different calibers of firearms 11.

The rigid housing 16 is formed of a first generally cylindrical member 25 and a second generally cylindrical member 40. The first member 25 has a first end portion 26, a second end portion 27, a longitudinal axis 28, an exterior surface 29, at least one O-ring groove 34 is defined in the exterior surface 29 preferably proximate the second end portion 27, an elongate medial channel 30, an exterior diameter 33, an interior diameter 35, and threads 32 defined in an interior surface 31 of the elongate medial channel 30.

The second member 40 is releasably axially received in the elongate medial channel 30 defined by the first member 25. The second member 40 has a first end portion 41, a second end portion 42, a longitudinal axis 43, an exterior surface 44, a battery chamber 45, a laser chamber 46, an electronics chamber 47, threads 48 defined in the exterior surface 44 proximate the second end portion 42, and an extraction ring 49 proximate the first end portion 41, and an O-ring groove 34 is defined in the exterior surface 44 preferably proximate the first end portion 41. The extraction ring 49 may be configured to retain an O-ring in addition to and/or in substitution of the O-ring groove 34.

The power supply 60, which is preferably formed of plural stacked battery cells, such as, but not limited to watch batteries, is releasably carried within the battery chamber 45 defined in the second member 40. A circumferentially extending protective sheath 62 extends about the power supply 60 to protect and electrically and thermally insulate the power supply 60.

The laser 54 is preferably a diode laser 54, but is not limited to a diode laser 54. The laser 54 is releasably carried within the laser chamber 46 defined in the second member 40. The laser 54 is of known circuitry and has a laser emitting end portion 55 and an electronics end portion 56. The laser 54, when actuated, emits a laser beam 58 from the laser emitting end portion 55, and the laser beam 58 is projected along a longitudinal axis 19 of the rigid housing 16 and along a bore 12A of the firearm 11 and outwardly from a muzzle 12B of the firearm 11. The laser beam 58 may itself be visible (comprised of light waves within the visible light spectrum) or invisible (comprised of light waves outside the visible light spectrum), although the impact/strike point where the laser beam 58 impacts a target is visible and has a predetermined configuration and color, such as, but not limited to, a dot, a cross, an X, in the color red or in the color green, but not limited thereto.

The PC board 39 is of known electronics and is carried within the electronics chamber 47 defined in the second member 40. The PC board 39 operatively and electronically communicates with the laser 54 and with the power supply 60 so as to generate, when actuated, a signal that is communicated to the laser 54 which responsively causes the laser 54 to emit a laser beam 58 that is projected along the longitudinal axis 19 of the rigid housing 16 and along the bore 12A of the firearm 11 and outwardly from the firearm muzzle 12B. Circuitry 57 operatively communicates between the power supply 60 and the PC board 39, and between the power supply 60 and the laser 54, and between the PC board 39 and the laser 54 to provide the necessary electrical energy to the components.

The optical lens 40 is carried at the first end portion 41 of the second member 40. The optical lens 40 operatively communicates with the PC board 39 so as to collect and focus light 59 emitted from an electromagnetic light source 66 onto the PC board 39 so as to cause the PC board 39 to generate a signal that is communicated to the laser 54 so as to actuate the laser 54.

The laser training cartridge 10 (FIG. 1) is comprised of two axially interconnected two rigid members 25, 40 which are threaded to screw together to form a rigid housing 16. The first member 25 on its outside and the second member 40 on its inside. The first member 25 of the rigid housing 16 defines an O-ring groove 34 around its second end portion 27 so that an O-ring 63 will stay secured in place on the rigid housing 16. This O-ring 16 fits inside the chamber 13 of the firearm 11 to hold the laser cartridge 10 in place and make sure the device is centered inside the chamber 13.

The first and second members 25, 40 respectively of the rigid housing 16 are machined inside to hold a diode laser 54, The diode laser 54 is in physical contact with a power source 60 which is comprised of plural stacked battery cells. The power source 60 is in operative contact with the electronic PC board 64. The power source 60 is retained within and insulated by a battery protective sheath 62.

The first end portion 41 of the second member 40 of the rigid housing 16 is machined to define a recess to receive optical lens 65.

When all of these parts are assembled as described above, the assembly makes up the laser cartridge 10 for dry fire training. When the laser cartridge 10 is inserted into the chamber 13 of the firearm 11, in conjunction with the DryFireMag training magazine which is equipped with electronics and an electromagnetic light emitting light source, which may be, but is not limited to an LED, to pass a light signal 59 to the laser cartridge 10, realistic dry fire training practice can take place. The light signal 59 passes through the optical lens 65 and is passed to and received by the PC board 64. The PC board 64, is powered by the power supply 60, responds to the light signal 59 from the DryFireMag training device 15 and generates a signal that is operatively communicated to and which actuates the diode laser 34, which responsively generates and transmits a laser beam 58, which may be a pulse, or a continuous beam, and transmits the beam along a bore 12A of the firearm 11 and outwardly of the firearm's muzzle 12B and thereafter to a location where the firearm 11 is aimed. This allows the shooter to detect the accuracy of the shooter's ability to control the aiming of the firearm 11. The laser beam 58 emitted from the laser 54 and outwardly from the firearm muzzle 12B preferably has a wavelength of between approximately 600 and 700 nanometers, and more preferably between approximately 645 and 655 nanometers, and even more particularly of approximately 650 nanometers.

When coupled with the DryFireMag training device 15 that has an electromagnetic light source 66, the shooter does not need to remove the sub dominant hand from the firearm 11 to reset the trigger for a follow-up shots, but these two devices working together allow multiple trigger presses, one after the other. This laser training device is the only way that truly, realistic training can take place with the shooter being able to detect the accuracy of shots.

Operation

Having described the structure of my laser cartridge for dry fire training, is operation is now briefly described.

A power supply 60 is placed within the battery chamber 45 of the second member 40. The second member 40 is axially inserted into the elongate medial channel 30 defined by the first member 25, with the second end portion 42 of the second member 40 being inserted first. The second member 40 is then axially screwed into the first member 25 by axially rotating the second member 40 relative to the first member 25.

The thusly assembled laser cartridge 10 is inserted into the chamber 13 of the firearm 11 that will be used in the dry fire training.

The dry fire magazine 15 which includes the light source 66 is activated (such as by moving an operating switch to an "on" position), and thereafter the dry fire magazine 15 is inserted into the firearm's magazine compartment and positionally secured in position so that the light source 66, when actuated by a trigger pull of the firearm 11, generates a light signal 59 that is passed at least partially into the firearm's chamber 13 where the light signal 59 is received by the optical lens 65, which, in response to receiving the light signal 59 responsively causes the PC board 64 to generate a signal that is operatively communicated to the laser 54, which responsively generates a laser beam 58 that is projected/transmitted linearly outwardly from the firearm's muzzle 12B. Known circuitry 57 provides the operative communication. In one contemplated embodiment, the light signal 59 may be an infrared light signal 59, and the infrared light signal 59 preferably has a wavelength of between approximately 900 and 980 nanometers and more preferably a wavelength of approximately 940 nanometers. In other contemplated embodiments, the light signal 59 is formed of electromagnetic waves, emitted from a source 66 of electromagnetic radiation having wavelengths other than in the infrared range, such as, but not limited to, ultraviolet light, human visible light, human invisible light, microwaves, etc.

A principal object of the present invention is a laser cartridge 10 for dryfire training with a firearm 11 that has a trigger actuated electromagnetic wave source 66 that, when actuated by the firearm trigger, passes electromagnetic waves into the firearm's chamber 13, the laser cartridge 10 comprising: a rigid housing 16 that is generally configured as an ammunition cartridge and that is removably carried within the firearm's chamber 13, the rigid housing 16 comprising; a first member 25 defining an elongate medial channel 30; and a second member 40 that is releasably axially received in the elongate medial channel 30 defined by the first member 25; a PC board 39 carried within an electronics chamber 47 defined in the second member 40, the PC board 39 operatively communicating with a power supply 35 and with a diode laser 31; the power supply 60 is releasably carried within a battery chamber 45 defined in the second member 40 and supplies power to both the PC board 39 and the diode laser 54; the diode laser 54 is carried within a laser chamber 46 defined in the second member 40, and when actuated upon receipt of the signal from the PC board 39, emits a laser beam 58 that is projected along a longitudinal axis 19 of the rigid housing 16 and along a bore 12A of the firearm 11 barrel 12; and an optical lens 40 carried at the first end portion 41 of the second member 40 and operatively communicating with the electronic PC board 39 so as to collect and focus electromagnetic waves 59 emitted from the electromagnetic light source 66 onto the PC board 39 so as to cause the PC board 39 to actuate the diode laser 54.

A further object of the present invention is a laser cartridge 10 wherein the first member 25 that has a first end portion 26, a second end portion 27, a longitudinal axis 28, an exterior surface 29, an O-ring groove 34, defined in the exterior surface 29 proximate the second end portion, an exterior diameter 33, an interior diameter 35, and threads 32 defined in an interior surface 31.

A further object of the present invention is a laser cartridge 10 wherein the second member 40 has a first end portion 41, a second end portion 42, a longitudinal axis 43, an exterior surface 44, threads 48 defined in the exterior surface 44 proximate the second end portion 42, and an extraction ring 49 proximate the first end portion 41.

A further object of the present invention is a laser cartridge 10 further comprising: a protective sheath 62 extending about the power supply 60 to electrically insulate the power supply 60 from the rigid housing 16.

A further object of the present invention is a laser cartridge 10 wherein the diode laser 54 has a laser emitting end portion 55 proximate the second end of the rigid housing 16, and an electronics end portion 56 proximate the first end portion, and the battery compartment 45 is between the laser emitting end portion 55 and the electronics end portion 56.

A further object of the present invention is a laser cartridge 10 wherein the diode laser 54, when actuated, emits a red color laser beam 58.

A further object of the present invention is a laser cartridge 10 wherein the diode laser 54, when actuated emits a green color laser.

A further object of the present invention is a laser cartridge 10 wherein the diode laser 54, when actuated, emits a continuously emitted laser beam 58.

A further object of the present invention is a laser cartridge 10 wherein the diode laser 54, when actuated, emits a pulsed laser beam 58.

A further object of the present invention is a laser cartridge 10 wherein the diode laser 54, when actuated, emits a laser beam 58 that visually appears on a target in the shape of a dot.

A further object of the present invention is a laser cartridge 10 wherein the diode laser 54, when actuated, emits a laser beam 58 that visually appears on a target in a predetermined shape.

A further object of the present invention is a laser cartridge 10 wherein the diode laser 54, when actuated, emits a laser beam 58 that visually appears on a target in the shape of a cross or an "X".

A further object of the present invention is a laser cartridge 10 wherein the laser 54, when actuated, emits a laser beam 58 having a wavelength between approximately 600 nanometers and 700 nanometers.

A further object of the present invention is a laser cartridge 10 wherein the diode laser 54, is actuated when the PC board receives an infra-red signal having a wavelength of between approximately 900 nanometers and 980 nanometers.

A still further object of the present invention is a laser cartridge 10 wherein the diode laser 54, is actuated when the PC board receives an infra-red signal having a wavelength of 940 nanometers.

An even still further object of the present invention is a laser cartridge 10 for dryfire training with a firearm 11 that has a trigger actuated light source 66 that, when actuated by the firearm trigger, passes light into the firearm's chamber 13, the laser cartridge 10 comprising: a generally cylindrical rigid housing 16 that is generally configured in the shape of an ammunition cartridge, and that is releasably carried within the firearm's chamber 13, the generally cylindrical rigid housing 16 comprising; a first generally cylindrical member 25 of the rigid housing 16 that has a first end portion 26, a second end portion 27, a longitudinal axis 28, an exterior surface 29, an O-ring groove 34 defined in the exterior surface 29 proximate the second end portion 27, an elongate medial channel 30, an exterior diameter 33, an interior diameter 35, and threads 32 defined in an interior surface 31 of the elongate medial channel 30; a second generally cylindrical member 40 that is releasably axially received in the elongate medial channel 30 defined by the first generally cylindrical member 25, the second generally cylindrical member 40 having, a first end portion 41, a second end portion 42, a longitudinal axis 43, an exterior surface 44, a battery chamber 45, a laser chamber 46, an electronics chamber 47, threads 48 defined in the exterior surface 44 proximate the second end portion 42, and an extraction ring 49 proximate the first end portion 41; a battery power supply 60 releasably carried within the battery chamber 45 defined in the second member 40, the battery power supply 60 having a circumferentially extending protective sheath 62 extending thereabout to insulate the battery power supply 60 from the rigid housing 16; a diode laser 54 carried within the laser chamber 46 defined in the second member 40, the diode laser 54 having a laser emitting end portion 55 and an electronics end portion 56, and the diode laser 54, when actuated, emits a laser beam 58 that is projected along a longitudinal axis 19 of the rigid housing 16 and along a bore 12A of the firearm 11 and outwardly from a muzzle 12B of the firearm 11; an electronic PC board 39 carried within the electronics chamber 47 defined in the second member 40, the electronic PC board 39 operatively communicating with the diode laser 54 and with the battery power supply 35 so as to generate, when actuated, a signal that is communicated to the diode laser 31 and which responsively causes the diode laser 54 to emit a laser beam 58 that is projected along the longitudinal axis 19 of the rigid housing 16 and along the bore 12A of the firearm 11 and outwardly from the firearm muzzle 12B; and an optical lens 40 carried at the first end portion 41 of the second member 40, the optical lens 40 operatively communicating with the electronic PC board 39 so as to collect and focus light 59 emitted from a light source 66 onto the electronic PC board 39 so as to cause the electronic PC board 39 to generate a signal that is communicated to the diode laser 54 so as to actuate the diode laser 54.

I claim:

1. A laser cartridge (10) for dryfire training with a firearm (11) that has an EMR source (66) that is actuated responsive to a trigger of the firearm (11) being pulled by a user/shooter, and wherein actuation of the EMOR source (66) passes EMR into a chamber (13) defined in the firearm (11), the laser cartridge (10) comprising:

a housing (16) that is configured as an ammunition cartridge and that is removably carried within the chamber (13) of the firearm (11), the housing (16) comprising:

a first member (25) defining a medial channel (30); and a second member (40) that is releasably axially received in the medial channel (30) defined by the first member (25); and a PC board (39) carried within an electronics chamber (47) defined in the second member (40), the PC board (39) operatively communicating with a power supply (60) and with a laser (54); and the power supply (60) is releasably carried within a battery chamber (45) defined in the second member (40) and the power supply (60) supplies power to both the PC board (39) and to the laser (54); and the laser (54) is carried within a laser chamber (46) defined in the second member (40) and when the laser 54 is actuated responsive to receipt of a signal from the PC board (39), the laser (54) emits a laser beam/pulse (58) that is projected along a longitudinal axis (19) of the housing (16) and along a bore (12A) of a barrel (12) of the firearm (11); and an optical lens (65) carried at a first end portion (41) of the second member (40) of the housing (16) and operatively communicating with the PC board (39) to collect and focus EMR (59) emitted by the EMR source (66) onto the PC board (39) to cause the PC board (39) to generate the signal that is communicated to the laser (54) to actuate the laser (54) to emit the laser beam/pulse (58).

2. The laser cartridge (10) as claimed in claim 1 and wherein the first member (25) of the housing (16) has a first end portion (26), a second end portion (27), a longitudinal axis (28), an exterior surface (29), an O-ring groove (34), defined in the exterior surface (29) proximate the second end portion (27) that carries an O-ring (63) therein, an exterior diameter (33), an interior diameter (35), and threads (32) defined in an interior surface (31) of the medial channel (30).

3. The laser cartridge (10) as claimed in claim 1 and wherein the second member (40) of the housing (16) has a first end portion (41), a second end portion (42), a longitudinal axis (43), an exterior surface (44), threads (48) defined in the exterior surface (44) proximate the second end portion (42), and an extraction ring (49) proximate the first end portion (41).

4. The laser cartridge (10) as claimed in claim 1 and further comprising:

a protective sheath (62) extending about the power supply (60) to insulate the power supply (60) from the housing (16).

5. The laser cartridge (10) as claimed in claim 1 and wherein the laser (54) has a laser emitting end portion (55) that is positioned proximate the second end portion (42) of the second member (40) of the housing (16) when the laser (54) is carried within the laser chamber (46); and an electronics end portion (56) proximate the first end portion (41) of the second member (40) of the housing (16); and wherein the power supply (60) is adjacent the electronics end portion (56) of the laser (54).

6. The laser cartridge (10) as claimed in claim 1 and wherein the laser (54), when actuated, emits a red color laser beam/pulse (58).

7. The laser cartridge (10) as claimed in claim 1 and wherein the laser (54), when actuated emits a green color laser beam/pulse (58).

8. The laser cartridge (10) as claimed in claim 1 and wherein the laser (54), when actuated, emits a continuous laser beam (58).

9. The laser cartridge (10) as claimed in claim 1 and wherein the laser (54), when actuated, emits a pulsed laser (58).

10. The laser cartridge (10) as claimed in claim 1 and wherein the laser (54), when actuated, emits a laser beam/pulse (58) that visually appears on a target as a dot.

11. The laser cartridge (10) as claimed in claim 1 and wherein the laser (54), when actuated, emits a laser beam/pulse (58) that visually appears on a target in a predetermined shape.

12. The laser cartridge (10) as claimed in claim 1 and wherein the laser (54), when actuated, emits a laser beam/pulse (58) that visually appears on a target as a cross or as an "X".

13. The laser cartridge (10) as claimed in claim 1 and wherein the laser (54), when actuated, emits a laser beam/pulse (58) having a wavelength between 600 nanometers and 700 nanometers.

14. The laser cartridge (10) as claimed in claim 1 and wherein the laser (54), when actuated, emits a laser beam/pulse (58) having a wavelength between 645 nanometers and 655 nanometers.

15. The laser cartridge (10) as claimed in claim 1 and wherein the laser (54), when actuated, emits a laser beam/pulse (58) having a wavelength of 650 nanometers.

16. The laser cartridge (10) as claimed in claim 1 and wherein the laser (54), is actuated when the PC board (39) receives EMR having a wavelength of between 900 nanometers and 980 nanometers.

17. The laser cartridge (10) as claimed in claim 1 and wherein the laser (54), is actuated when the PC board 39 receives EMR having a wavelength of 940 nanometers.

18. A laser cartridge (10) for dryfire training with a firearm (11) that has an EMR source (66) that is actuated responsive to a trigger of the firearm (11) being pulled by a user/shooter, and wherein actuation of the EMR source (66) passes EMR into a chamber (13) defined in the firearm (11), the laser cartridge (10) comprising:

a housing (16) that is configured in the shape of an ammunition cartridge, and that is releasably carried within the chamber (13) defined in the firearm (11), the housing (16) comprising;

a first cylindrical member (25) that has a first end portion (26), a second end portion (27), a longitudinal axis (28), an exterior surface (29), an O-ring groove (34) defined in the exterior surface (29) proximate the second end portion (27), a medial channel (30), an exterior diameter (33), an interior diameter (35), and threads (32) defined in an interior surface (31) of the medial channel (30);

a second member (40) that is releasably axially received in the medial channel (30) defined by the first cylindrical member (25), the second member (40) having, a first end portion (41), a second end portion (42), a longitudinal axis (43), an exterior surface (44), a battery chamber (45), a laser chamber (46), an electronics chamber (47), threads (48) defined in the exterior surface (44) proximate the second end portion (42), and an extraction ring (49) proximate the first end portion (41); and a power supply (60) releasably carried within the battery chamber (45) defined in the second member (401, the power supply (60) having a circumferentially extending protective sheath (62) extending thereabout to insulate the power supply (60) from the housing (16) and wherein the power supply (60) operative communicates with a PC board (39) and with a diode laser (54) with circuitry (57);

the diode laser (54) is carried within the laser chamber (46) defined in the second member (40), the diode laser (54) having a laser emitting end portion (55) and an electronics end portion (56), and the diode laser (54) when actuated, emits a laser beam/pulse (58) that is projected along a longitudinal axis (19) of the housing (16) and along a bore (12A) of the firearm (11) and outwardly from a muzzle (12B) of the firearm (11); and the PC board (39) is carried within the electronics chamber (47) defined in the second member (40), the PC board (39) operatively communicating with the diode laser (54) and with the power supply (60) generate, when actuated, a signal that is communicated to the diode laser (54) and which responsively causes the diode laser (54) to emit a laser beam/pulse that is projected along the longitudinal axis (19) of the housing (16) and along the bore (12A) of the firearm (11) and outwardly from the firearm muzzle (12B); and an optical lens (65) carried at the first end portion (41) of the second member (40) of the housing (16), the optical lens (65) operatively communicating with the electronic PC board (39) to collect and focus EMR (59) emitted from the EMR source (66) onto the PC board (39) to cause the PC board (39) to generate the signal that is communicated to the diode laser (54) to actuate the diode laser (54).

* * * * *